US006785992B2

(12) United States Patent
Chiarucci

(10) Patent No.: US 6,785,992 B2
(45) Date of Patent: Sep. 7, 2004

(54) EMERGENCY EXIT SIGN

(76) Inventor: Orlando G. Chiarucci, 3400 Mehaffle Dr., NE., North Canton, OH (US) 44721

( * ) Notice: Subject to any disclaimer, the term of this patent is extended or adjusted under 35 U.S.C. 154(b) by 0 days.

(21) Appl. No.: 10/444,214

(22) Filed: May 22, 2003

(65) Prior Publication Data

US 2003/0217494 A1 Nov. 27, 2003

Related U.S. Application Data

(60) Provisional application No. 60/382,658, filed on May 22, 2002.

(51) Int. Cl.[7] ..... G09F 7/00
(52) U.S. Cl. ..... 40/596; 40/616
(58) Field of Search ..... 40/596, 606.07, 40/616, 584, 542, 570

(56) References Cited

U.S. PATENT DOCUMENTS

| | | | | | |
|---|---|---|---|---|---|
| 1,209,183 | A | | 12/1916 | Malpas | |
| 1,803,114 | A | * | 4/1931 | Hoenig | 40/596 |
| 2,509,558 | A | | 5/1950 | Cadjew | |
| 2,549,893 | A | * | 4/1951 | Cook | 40/596 |
| 3,131,495 | A | * | 5/1964 | Stodola | 40/584 |
| 4,385,586 | A | | 5/1983 | Schriever | |
| 4,401,050 | A | | 8/1983 | Britt et al. | |
| 4,480,399 | A | * | 11/1984 | Teti, Jr. | 40/584 |
| 4,715,743 | A | | 12/1987 | Schmanski | |
| 4,877,405 | A | | 10/1989 | Stewart | |
| 5,167,087 | A | | 12/1992 | Plumly | |
| 5,302,049 | A | | 4/1994 | Schmanski | |
| 5,309,863 | A | | 5/1994 | Leeb, Jr. | |
| 5,320,790 | A | | 6/1994 | Lowe | |
| 5,328,293 | A | | 7/1994 | Keefe | |
| 5,331,918 | A | | 7/1994 | Honigsbaum | |
| 5,353,535 | A | | 10/1994 | Plumly | |
| 5,363,579 | A | | 11/1994 | Plumly | |
| 5,428,914 | A | | 7/1995 | Whitehouse et al. | |
| 5,524,373 | A | | 6/1996 | Plumly | |
| 5,555,660 | A | | 9/1996 | Whitehouse et al. | |
| 5,572,183 | A | | 11/1996 | Sweeney | |
| 5,626,094 | A | | 5/1997 | Jeffery et al. | |
| 5,775,016 | A | | 7/1998 | Chien | |
| 5,791,110 | A | | 8/1998 | Traynor | |
| 5,887,389 | A | | 3/1999 | Light | |
| 5,904,017 | A | | 5/1999 | Glatz et al. | |
| 5,916,102 | A | | 6/1999 | Peyton | |
| 5,989,369 | A | | 11/1999 | Light | |
| 6,025,773 | A | | 2/2000 | Bresnan | |
| 6,058,635 | A | * | 5/2000 | Morris | 40/570 |
| 6,150,943 | A | | 11/2000 | Lehman et al. | |
| 6,228,194 | B1 | | 5/2001 | Cowen | |
| 6,237,266 | B1 | | 5/2001 | Tassey et al. | |
| 6,249,221 | B1 | | 6/2001 | Reed | |
| 6,276,634 | B1 | | 8/2001 | Bodle | |
| 6,367,218 | B2 | | 4/2002 | Lombardo | |
| 6,472,994 | B1 | * | 10/2002 | Tator | 40/595 |
| 2001/0049894 | A1 | * | 12/2001 | Ingraham | 40/584 |

* cited by examiner

*Primary Examiner*—Gary C. Hoge
(74) *Attorney, Agent, or Firm*—Sand & Sebolt

(57) ABSTRACT

An emergency exit sign is incorporated directly into the floor adjacent an emergency exit door. The emergency exit sign includes visual and tactile properties that allow the sign to be read on a day to day basis by those walking through the doorway. The tactile properties of the sign also allow the sign to be read by those on the floor in an emergency situation such as when the room or hallway is filled with smoke. The tactile properties of the sign may also be used by those trying to find the doorway in a dark room. Further, the tactile properties of the sign are used on a day to day basis as people walk over the sign to reinforce the person's memory of the location of the emergency exit door.

18 Claims, 7 Drawing Sheets

EMERGENCY EXIT SIGN

CROSS-REFERENCE TO RELATED APPLICATIONS

This application claims priority from U.S. provisional application serial No. 60/382,658 filed May 22, 2002; the disclosures of which are incorporated herein by reference.

BACKGROUND OF THE INVENTION

1. Technical Field

The present invention generally relates to signs and, more particularly, to directional and informational signs. Specifically, the present invention relates to a emergency exit sign that may be viewed under normal conditions as well as being used in emergency situations. The sign may be visually read under normal lighting conditions and has tactile properties that allow the sign to indicate an emergency exit during low visibility conditions.

2. Background Information

Marking emergency exits in commercial buildings is required by law. The signs that mark emergency exits are typically used in the case of power failures, fires, and other emergency situations. Numerous different types of emergency exit signs exist in the art including those that use lights and those that have tactile properties to guide people in the direction of an emergency exit door.

BRIEF SUMMARY OF THE INVENTION

The invention provides an emergency exit sign that is incorporated directly into the floor in front of an emergency exit door. The sign incorporated into the floor includes visual and tactile properties that allow the sign to be read on a day to day basis by those walking through the doorway. The tactile properties of the sign also allow the sign to be read by those on the floor in an emergency situation such as when the room or hallway is filled with smoke. The tactile properties of the sign may also be used by those trying to find the doorway in a dark room. Further, the tactile properties of the sign are used on a day to day basis as people walk over the sign to reinforce the person's memory of the location of the emergency exit door.

One embodiment of the invention provides an emergency exit sign fabricated from tiles with the letters of the emergency exit sign fabricated from a tactile tile placed in a background material. The background material may be a smooth tile or a tactile tile. Another embodiment of the invention provides an emergency exit sign fabricated from tiles wherein the letters of the sign are provided in a relatively smooth tile set in tactile background tiles. A further embodiment of the invention provides an emergency exit sign wherein the letters of the sign are formed from a plurality of tiles set in a background material.

The invention provides that the sign may be placed on the floor in front of the exit, on the exit door, or on a wall next to the door.

BRIEF DESCRIPTION OF THE SEVERAL VIEWS OF THE DRAWINGS

Similar numbers refer to similar parts throughout the specification.

DETAILED DESCRIPTION OF THE INVENTION

Figure 1:
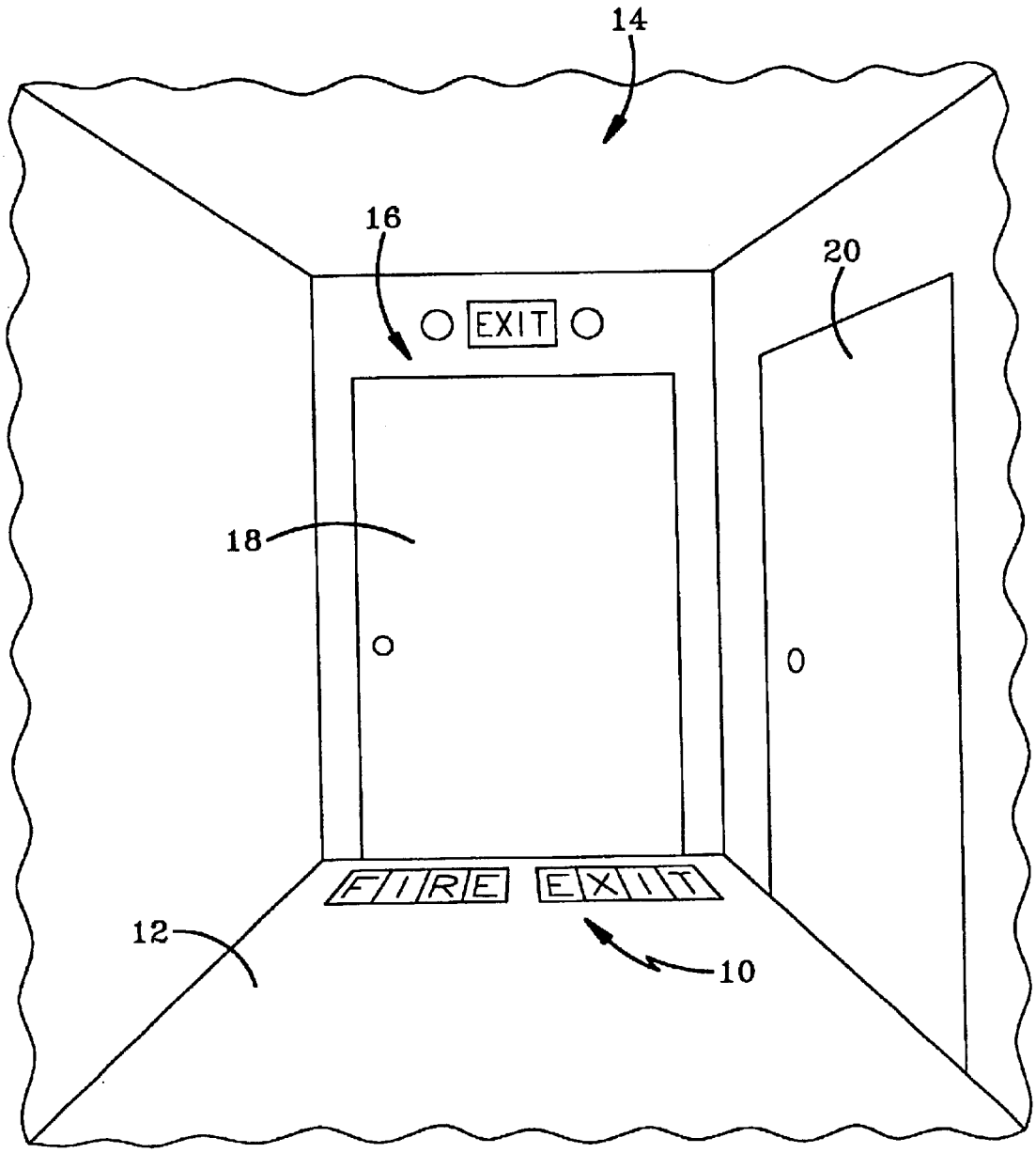
FIG. 1 is a perspective view of a hallway incorporating the emergency exit sign of the present invention.
Figure 2:
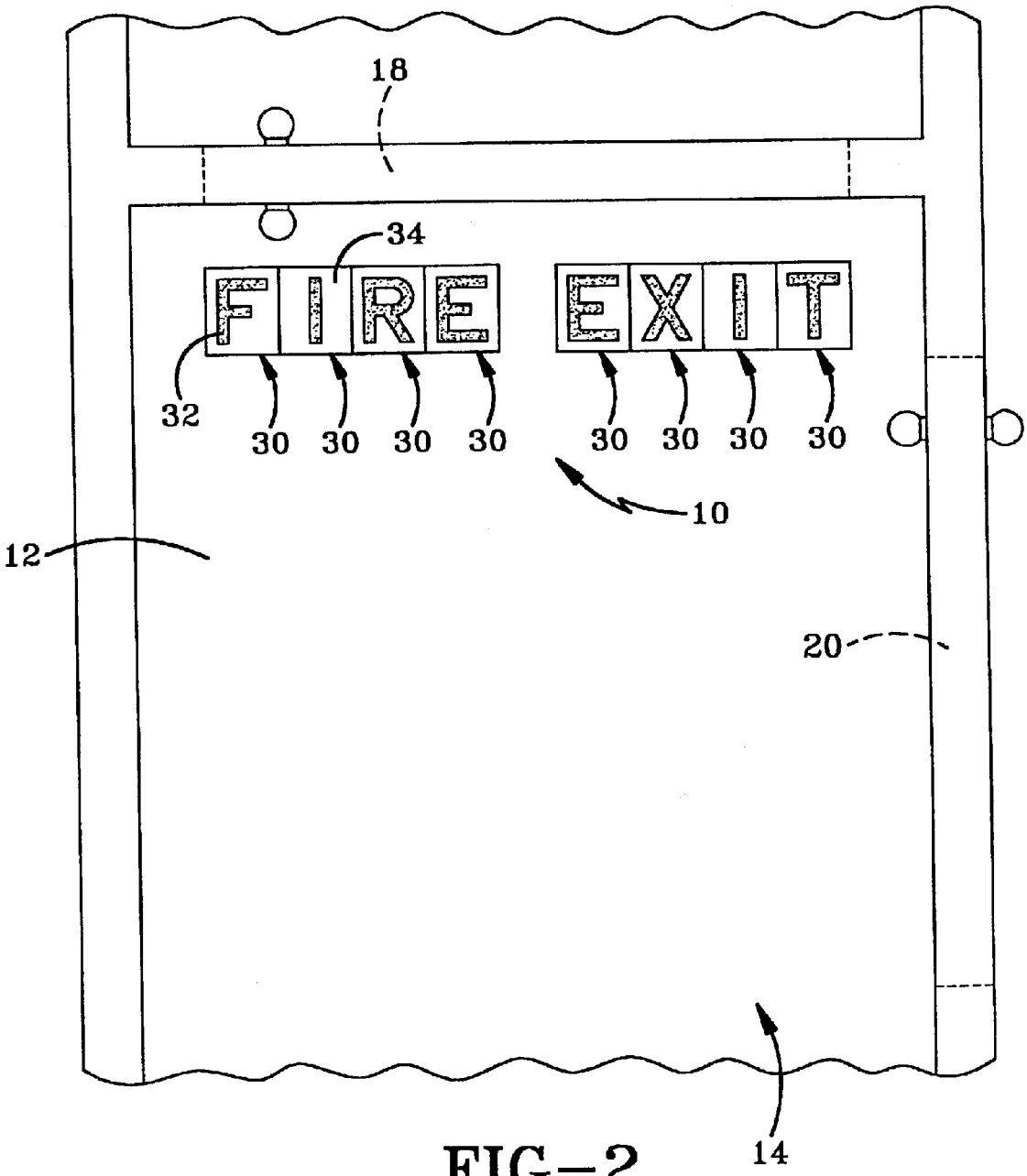
FIG. 2 is a top plan view of a first embodiment of the emergency exit sign of the present invention.

The first embodiment of the emergency exit sign of the present invention is indicated generally by the numeral 10 in FIGS. 1 and 2. Sign 10 is located on or in the floor 12 in a room or hallway 14 that has at least one exit 16 that is designed to be used in an emergency situation. A door 18 may be located at exit 16. An additional door 20 may also be present in hallway or room 14. Sign 10 allows a person in hallway or room 14 to distinguish between door 18 (to be used in emergency situations) and additional door 20 under conditions where time is of the essence and the person's vision may be impaired by darkness and/or smoke.

Emergency exit sign 10 is placed on top of floor 12. Sign 10 is preferably embedded within floor 12 by insetting tiles 30 so that the upper surface of each tile 30 is substantially coplanar with the upper surface of the material that covers floor 12. The material that covers floor 12 may be any of a variety of materials that are known in the art such as tile, carpet, vinyl, wood, etc. Tiles 30 may also be provided in relatively thin heights so that they may be placed on top of flooring materials if such a configuration is desirable. Although tiles 30 are the preferred embodiment of the invention, sign 10 may be fabricated from other materials capable of supporting a textured surface such as concrete, wood, metal, plastic, glass, fabric, and polymers.

Tiles 30 include visual indicators that may be read by a person looking at sign 10. The visual indicator is designed to be visually understood to represent an emergency exit doorway so that a person looking at sign 10 will understand that door 18 is be used in case of emergency. In the embodiment of the invention depicted in the drawings, eight tiles 30 are used to spell "FIRE EXIT." In other embodiments of the invention, other wording or symbols may be used to show people that door 18 is to be used in case of emergency instead of door 20. For instance, sign 10 may read "EXIT" or "EMERGENCY EXIT" or "TORNADO SHELTER." In the manner of typically visually-readable signs, persons repeatedly using door 18 will constantly see sign 10 and remember the location of door 18.

In addition to the visual indicator on each tile 30 or the combination of tiles 30, sign 10 provides a tactile indicator that may be used by a person in room 14 in a blackout or when smoke is filling room 14. In these situations, a person in room 14 can feel sign 10 with a foot or a hand to determine that door 18 is the emergency exit door instead of additional door 20. In the first embodiment of the invention depicted in FIGS. 1 and 2, each letter or visual indicator formed in each tile 30 is fabricated from a tactile tile material that is rougher than the background material. As such, each visual indicator 32 has a roughness that is substantially different than background material 34. This roughness difference may be achieved by fabricating visual indicator 32 from a nonslip tile material that is commonly used on floors where water is present to prevent slipping. Another advantage of sign 10 is that the use of tactile materials with visual indicators 32 reinforces a person's memory as they walk over sign 10 each day because the people will feel the roughness difference with their shoes. Tactile material may also be used when one is on their hands and knees searching for emergency door 18 in a blackout or smoke-filled-room condition. Any of a variety of known tactile materials may be used to form visual indicators 32. The embodiment of the invention depicted in FIG. 2 shows one letter per tile 30. The inventor contemplates that the letters may be formed in one large tile or that two letters may be formed in each individual tile 30.

Figure 3:
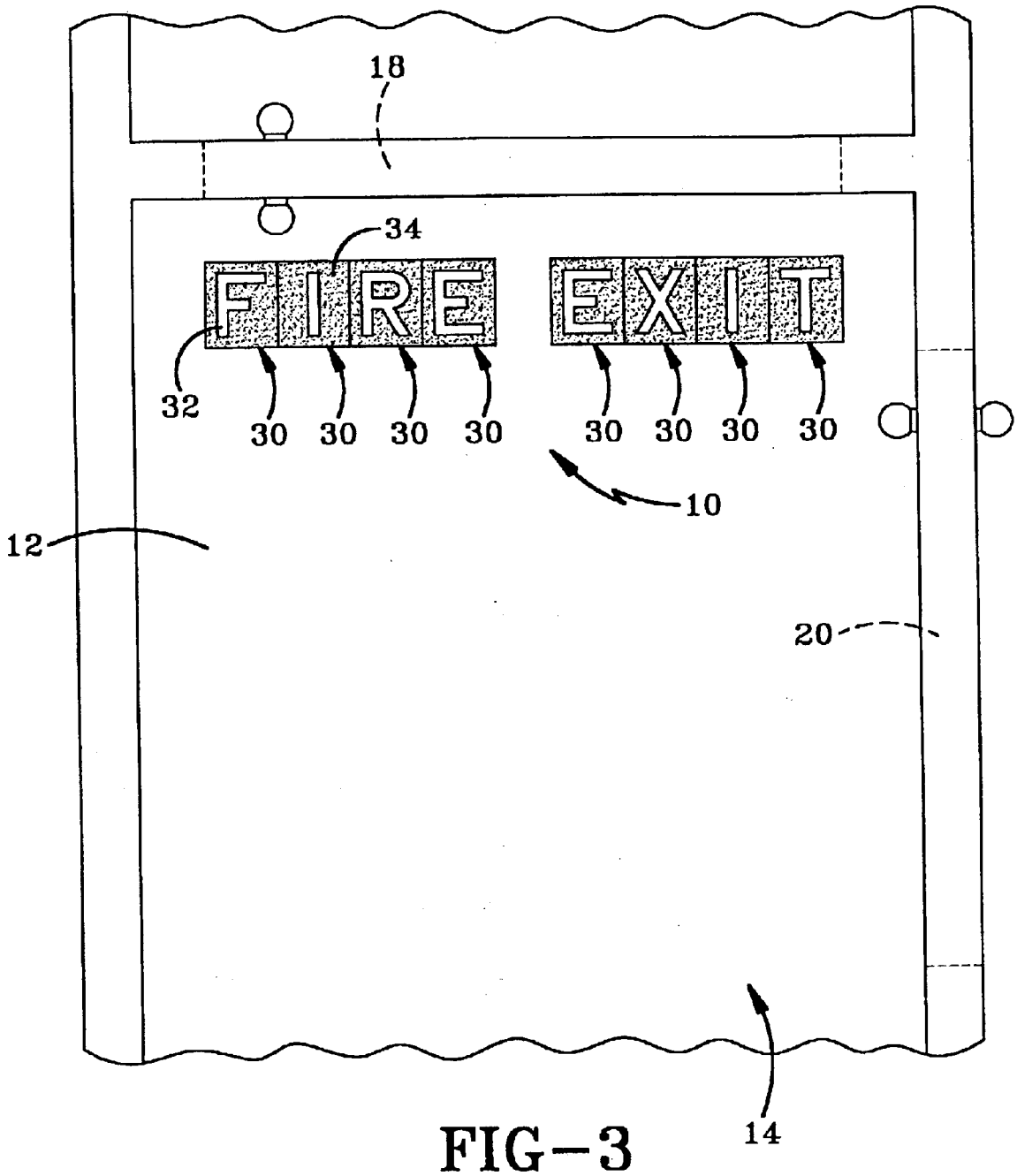
FIG. 3 is a top plan view of a second embodiment of the emergency exit sign of the present invention.

The second embodiment of the invention is depicted in FIG. 3. In FIG. 3, the visual indicators 32 are fabricated from the smooth or less rough material with background 34 being fabricated from the tactile material.

Figure 4:
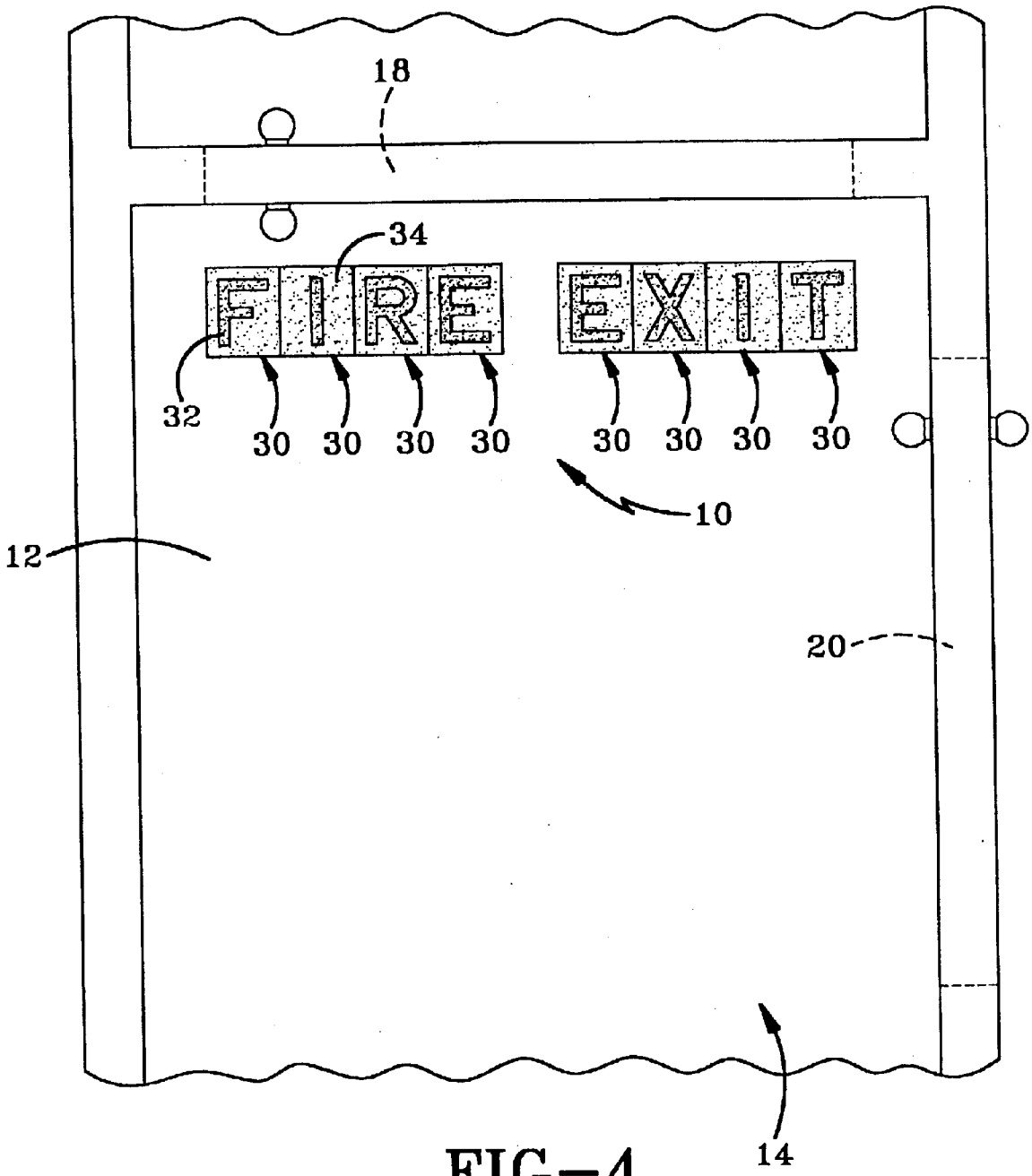
FIG. 4 is a top plan view of a third embodiment of the emergency exit sign of the present invention.

FIG. 4 shows a third embodiment of the invention wherein the visual indicators 32 are fabricated from a rough or nonslip tile and background material 34 is fabricated from a rough or nonslip tile. In this situation, visual indicators 32 may be fabricated from a different color and may be fabricated from a material having a different roughness from background material 34. Background material 34 may also be fabricated with a different roughness pattern (different sized dots or stripes than visual indicators 32.)

Figure 5:
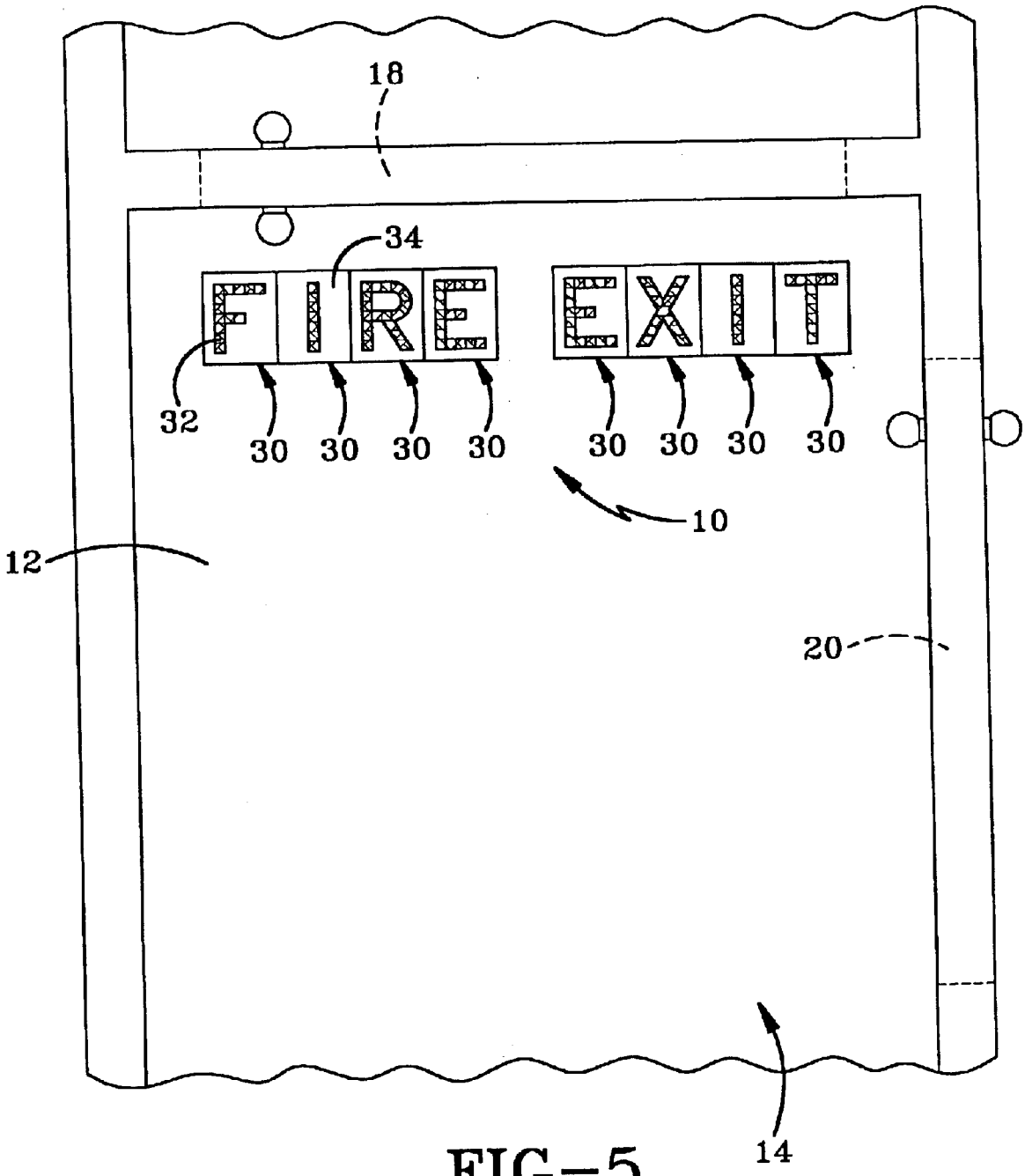
FIG. 5 is a top plan view of a fourth embodiment of the emergency exit sign of the present invention.

In the embodiment of the invention depicted in FIG. 5, visual indicators 32 are fabricated from a plurality of small mosaic type tiles that each have tactile properties.

Figure 6:
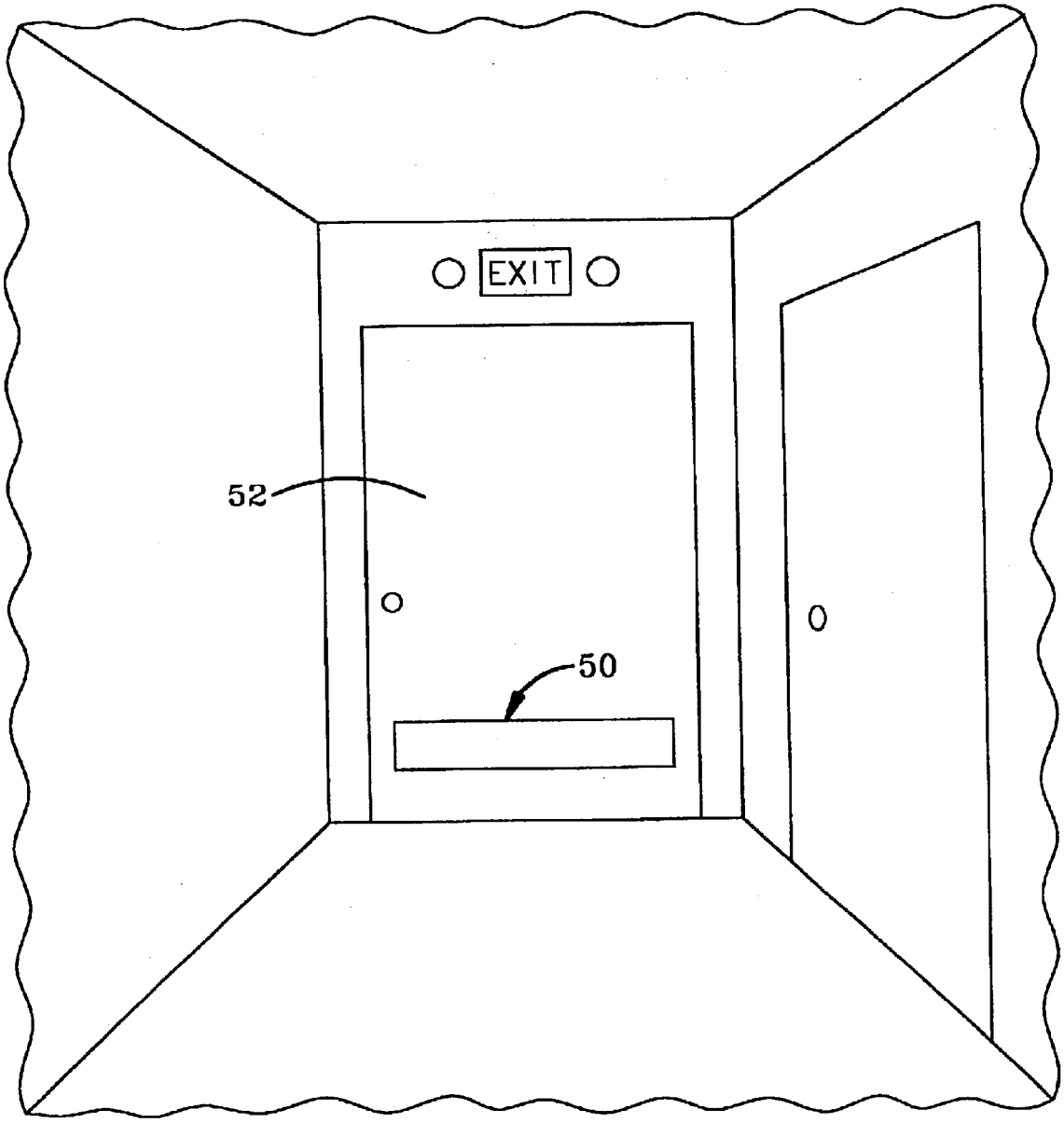
FIG. 6 is a perspective view of the hallway incorporating a fifth embodiment of the emergency exit sign of the present invention.

Another embodiment of the invention is depicted in FIG. 6. In FIG. 6, the emergency exit sign of the present invention is indicated generally by the numeral 50 and is disposed on the surface of door 52. Sign 50 may be fabricated from materials similar and in configurations similar to sign 10 described above.

Figure 7:
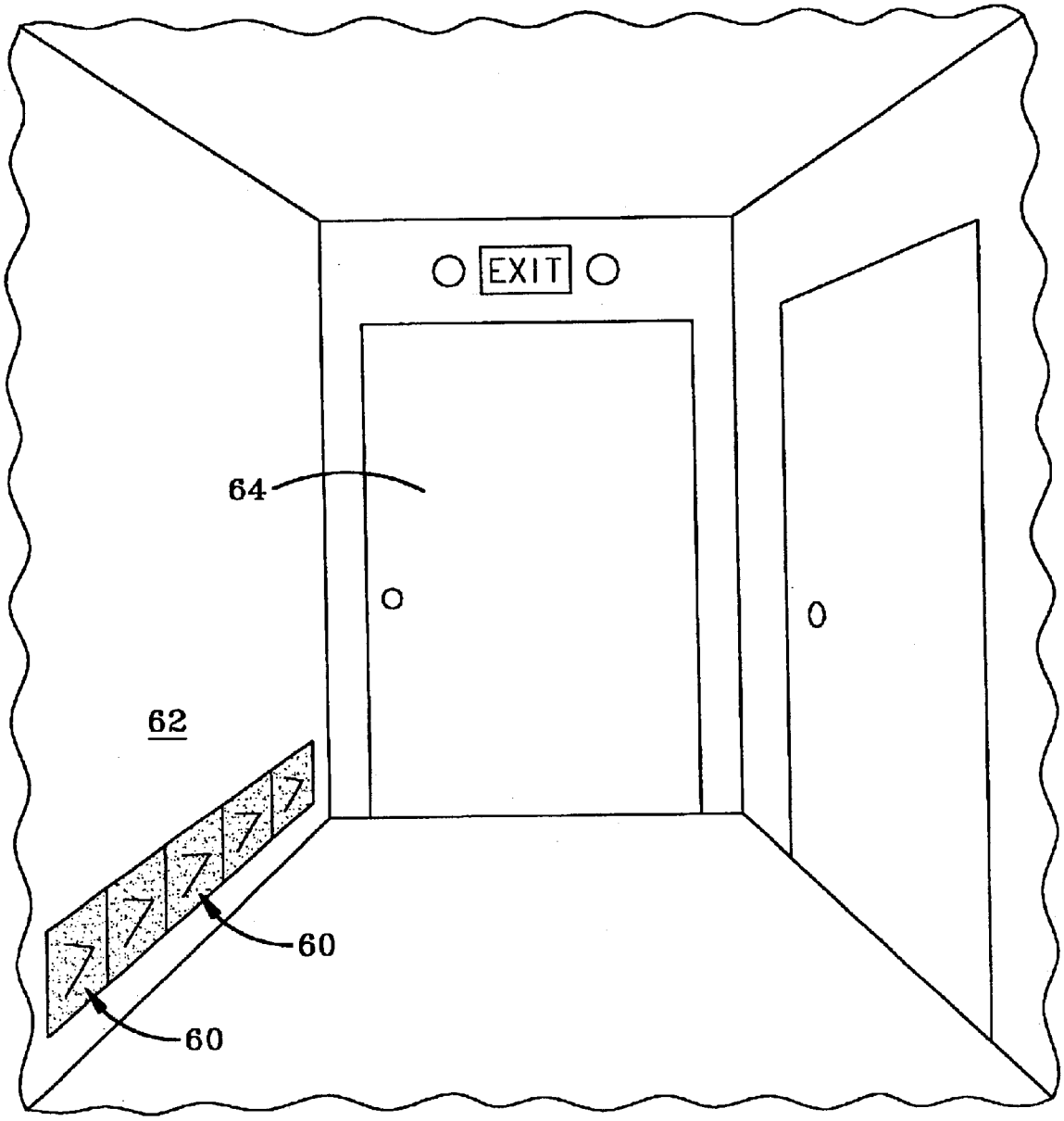
FIG. 7 is a perspective view of a sixth embodiment of the emergency exit sign of the present invention.

FIG. 7 depicts an alternative embodiment of the invention wherein tactile tiles 60 are provided on walls 62 to guide a person towards emergency exit door 64. Tiles 60 may include arrows that may be felt by a person guiding themselves along wall 62 in the dark or a smoke-filled-room configuration.

In the foregoing description, certain terms have been used for brevity, clearness, and understanding. No unnecessary limitations are to be implied therefrom beyond the requirement of the prior art because such terms are used for descriptive purposes and are intended to be broadly construed. In each of the embodiments described above, sign 10, 50, or 60 is positioned adjacent floor 12 so that a person crawling along floor 12 in a low visibility condition will be able to reach and feel the tactile materials to guide him to door 18.

Moreover, the description and illustration of the invention is an example and the invention is not limited to the exact details shown or described.

What is claimed is:

1. A room having a floor, a wall, at least one emergency exit door and at least one additional door that is not intended to be used in an emergency situation; and an emergency exit sign positioned adjacent the emergency exit door and adjacent the floor; the emergency exit sign having visually-readable language adapted to indicate to the reader that the emergency exit door is to be used to exit the room in case of an emergency; and the emergency exit sign having a tactile element that may be felt by a person on the floor to indicate to the person feeling the tactile element that the emergency exit door is to be used to exit the room in case of an emergency; and the emergency exit sign is embedded in the floor in front of the emergency exit door.

2. The room of claim 1, wherein the emergency exit sign includes at least one tile having a body with an upper surface; the visually-readable language defined by the body of the tile; the upper surface of the tile defining the tactile element that may be felt by the person.

3. The room of claim 2, wherein the visually-readable language defines the tactile property.

4. The room of claim 2, wherein the visual indicator is formed from a plurality of tiles.

5. The room of claim 2, wherein the tile has a roughened background.

6. The room of claim 5, wherein the visual indicator is roughened.

7. The room of claim 6, wherein the background is roughened to a different degree than the visual indicator.

8. The room of claim 1, wherein the visually-readable language is FIRE EXIT.

9. A room having a floor, a wall, at least one emergency exit door; and an emergency exit sign positioned adjacent the emergency exit door and connected to the floor where the sign may be felt by a person crawling on the floor; the emergency exit sign being formed from a plurality of tiles defining visually-readable language on a background; the visually-readable language adapted to indicate to the reader that the emergency exit door is to be used to exit the room in case of an emergency; and the tiles having a tactile element that may be felt by a person on the floor to indicate to the person feeling the tactile element that the emergency exit door is to be used to exit the room in case of an emergency.

10. The room of claim 9, wherein the tactile element is formed on the visually-readable language elements on the tiles.

11. The room of claim 9, wherein the tactile element is formed on the background of the tiles.

12. The room of claim 9, wherein the visually-readable language is formed from a plurality of tiles.

13. The room of claim 9, wherein the sign is connected to the door.

14. The room of claim 9, wherein the sign is connected to the wall.

15. The room of claim 9, wherein the visually-readable language includes a plurality of letters; each tile defining one of the letters.

16. The room of claim 15, wherein each of the letters is defined by a plurality of small tiles disposed inside the tile that defines the letter.

17. The room of claim 15, wherein the letter is roughened to provide the tactile element.

18. The room of claim 15, wherein the tile defining the letter is roughened to provide the tactile element.

* * * * *